US010217417B2

(12) United States Patent
Lee et al.

(10) Patent No.: US 10,217,417 B2
(45) Date of Patent: Feb. 26, 2019

(54) DISPLAY DEVICE AND DRIVING METHOD THEREOF

(71) Applicant: SAMSUNG DISPLAY CO., LTD., Yongin-si, Gyeonggi-do (KR)

(72) Inventors: Seung Kyu Lee, Yongin-si (KR); Min Woo Byun, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 87 days.

(21) Appl. No.: 15/253,593

(22) Filed: Aug. 31, 2016

(65) Prior Publication Data

US 2017/0069235 A1 Mar. 9, 2017

(30) Foreign Application Priority Data

Sep. 7, 2015 (KR) ..... 10-2015-0126430

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0861* (2013.01); *G09G 2310/0251* (2013.01); *G09G 2310/0262* (2013.01); *G09G 2310/0297* (2013.01)

(58) Field of Classification Search
None
See application file for complete search history.

(56) References Cited

U.S. PATENT DOCUMENTS

2001/0050665 A1* 12/2001 Yeo ..... G09G 3/3688 345/87
2006/0267885 A1* 11/2006 Kwak ..... G09G 3/3233 345/76
2007/0247398 A1* 10/2007 Nathan ..... G09G 3/3233 345/82
2008/0036704 A1* 2/2008 Kim ..... G09G 3/3233 345/76
2011/0090137 A1* 4/2011 Liu ..... G09G 3/3233 345/76

FOREIGN PATENT DOCUMENTS

KR 10-2010-0031003 A 3/2010

* cited by examiner

*Primary Examiner* — Duane N Taylor, Jr.
(74) *Attorney, Agent, or Firm* — Lewis Roca Rothgerber Christie LLP

(57) ABSTRACT

A display device includes a first pixel coupled to a scan line and a first data output line, a second pixel coupled to the scan line and a second data output line, a scan driver configured to supply a scan signal to the scan line, a data driver configured to supply a first data signal, a second data signal, and a first initializing voltage to a data input line, and a demultiplexer configured to receive the first data signal and the second data signal, to transmit the first data signal to the first data output line, and to transmit the second data signal and the first initializing voltage to the second data output line.

19 Claims, 7 Drawing Sheets

DISPLAY DEVICE AND DRIVING METHOD THEREOF

CROSS-REFERENCE TO RELATED APPLICATION

This application claims priority to, and the benefit of, Korean Patent Application No. 10-2015-0126430, filed on Sep. 7, 2015, in the Korean Intellectual Property Office, the entire content of which is incorporated herein by reference in its entirety.

BACKGROUND

1. Field

Aspects of the present invention relate to a display device and a driving method thereof.

2. Description of the Related Art

As information technology advances, the importance of a display device that serves as a medium between user and information is recognized more and more. Such has been reflected in the increase in usage of liquid crystal display devices, organic light emitting display devices, and/or the like.

Generally, a display device includes a data driver for supplying data signals to data lines, a scan driver for supplying scan signals to scan lines, and a plurality of pixels coupled to the scan lines and the data lines.

Conventionally, a structure in which a demultiplexer is added to output lines of the data driver in order to lower manufacturing cost has been proposed.

In other words, the demultiplexer may be input with data signals through output lines of the data driver and may output data signals in a time-shared manner to data lines whose number exceeds that of the output lines.

SUMMARY

Aspects of embodiments of the present invention are directed toward a display device and a method of driving the same suitable for high resolution.

According to some embodiments of the present invention, there is provided a display device including: a first pixel coupled to a scan line and a first data output line; a second pixel coupled to the scan line and a second data output line; a scan driver configured to supply a scan signal to the scan line; a data driver configured to supply a first data signal, a second data signal, and a first initializing voltage to a data input line; and a demultiplexer configured to receive the first data signal and the second data signal, to transmit the first data signal to the first data output line, and to transmit the second data signal and the first initializing voltage to the second data output line.

In an embodiment, the demultiplexer includes: a first transistor coupled between the data input line and the first data output line and configured to turn on in response to a first data control signal; and a second transistor coupled between the data input line and the second data output line and configured to turn on in response to a second data control signal.

In an embodiment, a first portion of the scan signal overlaps a portion of the first data control signal, and a second portion of the scan signal overlaps a portion of the second data control signal.

In an embodiment, the first data control signal and the second data control signal do not overlap each other.

In an embodiment, the first data control signal is supplied before the second data control signal.

In an embodiment, the data driver is configured to supply the first data signal to the data input line while the first data control signal is supplied, and to supply the second data signal and the first initializing voltage to the data input line in sequence while the second data control signal is supplied.

In an embodiment, the first initializing voltage is a voltage lower than that of the second data signal or is a lowest voltage within a voltage range of the second data signal.

In an embodiment, the first data control signal is supplied during a first period and a second period, the scan signal is supplied during the second period, a third period, and a fourth period, and the second data control signal is supplied during a fourth period and a fifth period.

In an embodiment, the display device further includes a third pixel coupled to the scan line and a third data output line, and the demultiplexer further includes a third transistor coupled between the data input line and the third data output line, the third transistor being configured to turn on in response to a third data control signal.

In an embodiment, a first portion of the scan signal overlaps a portion of the first data control signal, a second portion of the scan signal overlaps a portion of the second data control signal, and a third portion of the scan signal entirely overlaps the third data control signal.

In an embodiment, the first data control signal, the second data control signal, and the third data control signal do not overlap one another.

In an embodiment, the first data control signal is supplied before the second data control signal and the third data control signal, and the third data control signal is supplied before the second data signal.

In an embodiment, the data driver is configured to supply the first data signal to the data input line while the first data control signal is supplied, to supply the second data signal and the first initializing voltage to the data input line in sequence while the second data control signal is supplied, and to supply the third data signal and a second initializing voltage to the data input line in sequence while the third data control signal is supplied.

In an embodiment, the first initializing voltage is a voltage lower than that of the second data signal or is a lowest voltage within a voltage range of the second data signal, and the second initializing voltage is a voltage lower than that of the third data signal or is a lowest voltage within a voltage range of the third data signal.

In an embodiment, first data control signal is supplied during a first period and a second period, the scan signal is supplied during the second period, a third period, and a fourth period, the second data control signal is supplied during the fourth period and a fifth period, and a third data control signal is supplied during the third period.

In an embodiment, the first initializing voltage is the same as the second initializing voltage.

According to some embodiments of the present invention, there is provided a method for driving a display device, the method including: supplying a first data signal to a first data output line coupled to a first pixel during a turn on period of a first transistor in a demultiplexer; supplying a scan signal to a scan line coupled to the first pixel and a second pixel; and supplying, in sequence, a second data signal and a first initializing voltage to a second data output line coupled to the second pixel during a turn on period of a second transistor in the demultiplexer.

In an embodiment, a first portion of a supply period of the scan signal overlaps a portion of the turn on period of the first transistor, a second portion of the supply period of the scan signal overlaps a portion of the turn on period of the second transistor, and the turn on period of the first transistor precedes the turn on period of the second transistor.

In an embodiment, the scan line is further coupled to a third pixel, and the method further includes supplying a third data signal and a second initializing voltage, in sequence, to a third data output line coupled to the third pixel during a turn on period of a third transistor in the demultiplexer.

In an embodiment, a first portion of the supply period of the scan signal overlaps a portion of the turn on period of the first transistor, a second portion of the supply period of the scan signal overlaps a portion of the turn on period of the second transistor, a third portion of the supply period of the scan signal entirely overlaps the turn on period of the third transistor, the turn on period of the first transistor precedes the turn on period of the second transistor and the turn on period of the third transistor, and the turn on period of the third transistor precedes the turn on period of the second transistor.

Accordingly, there may be provided a display device and a method of driving the same capable of expressing high resolution and sufficiently securing a supply period of a scan signal.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. Like reference numerals refer to like elements throughout.

DETAILED DESCRIPTION

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly defined so herein.

Figure 1:
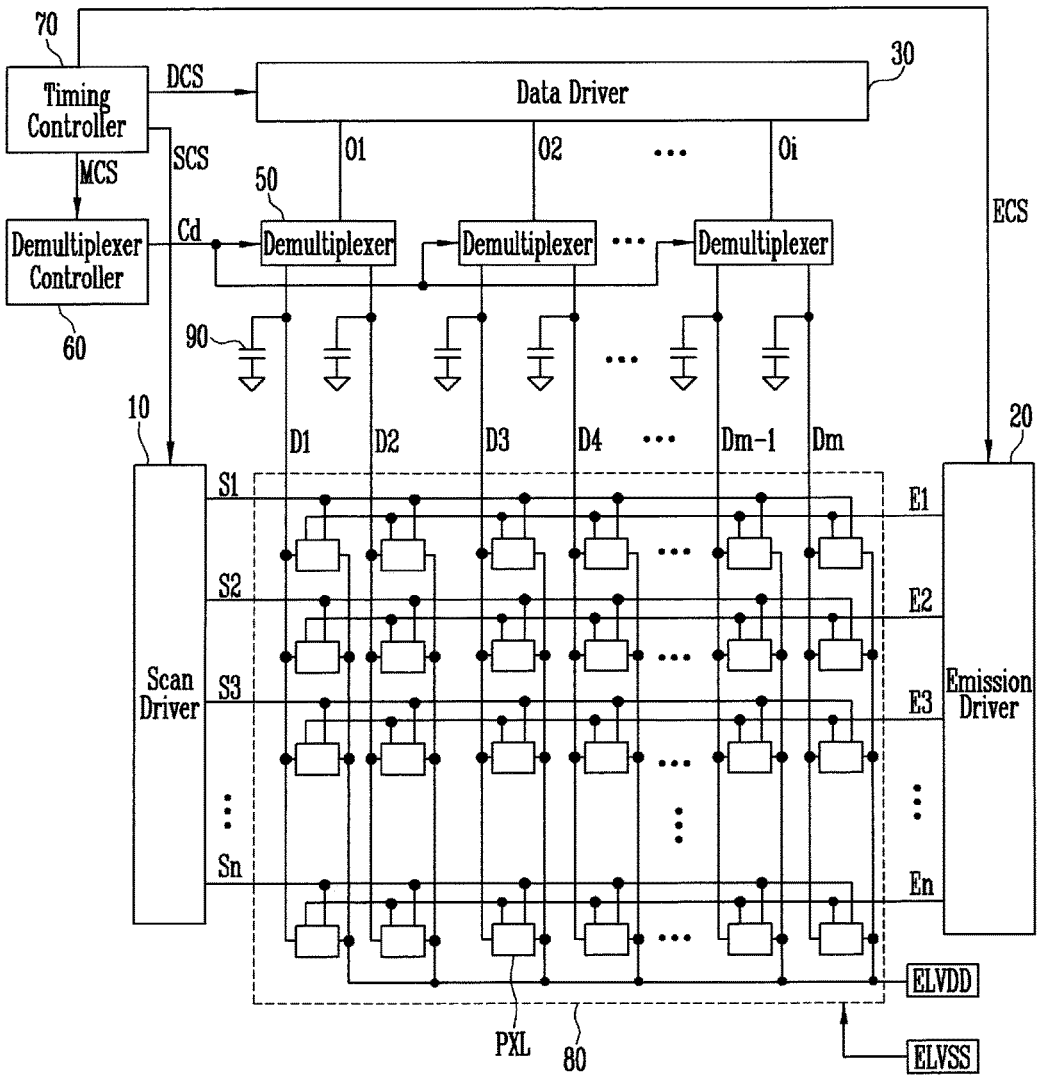
FIG. 1 illustrates a display device in accordance with an embodiment of the present invention.

FIG. 1 illustrates a display device in accordance with an embodiment of the present invention.

Referring to FIG. 1, a display device in accordance with an embodiment may include multiple pixels PXL, a scan driver 10, an emission driver 20, a data driver 30, demultiplexers 50, a demultiplexer controller 60, and a timing controller 70.

The pixels PXL may be coupled to multiple scan lines S1 to Sn and data output lines D1 to Dm. The pixels PXL may additionally be coupled to emission control lines E1 to En.

The interconnection relationship among the pixels PXL, the scan lines S1 to Sn, the data output lines D1 to Dm, and the emission control lines E1 to En may change in a variety of suitable manners.

For example, each pixel PXL may be coupled to a scan line and a data output line.

In another embodiment, each pixel PXL may be coupled to a scan line, a data output line, and an emission control line.

In yet another embodiment, each pixel PXL may be coupled to a plurality of scan lines.

The pixels PXL may be coupled to a first power supply ELVDD and a second power supply ELVSS and receive source voltages from them.

Each pixel PXL may generate light (corresponding to a data signal) according to a current that flows from the first power supply ELVDD to the second power supply ELVSS via an organic light emitting diode.

The scan driver 10 may generate scan signals by the control of the timing controller 70 and supply the generated signals to the scan lines S1 to Sn.

Thus, each pixel PXL may receive scan signals through the scan lines S1 to Sn.

The emission driver 20 may generate emission control signals by the control of the timing controller 70 and supply the generated emission control signals to the emission control lines E1 to En. Thus, each pixel PXL may receive emission control signals through the emission control lines E1 to En.

The emission driver 20 is shown to be separate from the scan driver 10 in FIG. 1; however, the emission driver 20 and the scan driver 10 may be realized as one body (e.g., as one integrated chip or unit) as desired.

In another embodiment, the emission driver 20 and the emission control lines E1 to En may be omitted.

The data driver 30 may generate data signals by the control of the timing controller 70 and supply the generated data signals to data input lines O1 to Oi. In other words, the data driver 30 may supply data signals to the demultiplexers 50 through the data input lines O1 to Oi. The data driver 30 may supply an initializing voltage to the data input lines O1 to Oi by the control of the timing controller 70.

For example, an initializing voltage may be set to be below a data signal or to be the same as the lowest voltage within the voltage range of the data signal.

Though FIG. 1 shows an example in which the number of the data input lines O1 to Oi is half the number of the data output lines D1 to Dm, the ratio of the data input lines O1 to Oi and the data output lines D1 to Dm may suitably vary depending on the structure of the demultiplexers 50.

The demultiplexers 50 may receive data signals from the data driver 30 and supply the data signals to the data output lines D1 to Dm.

For example, the demultiplexers 50 may receive data signals through the data input lines O1 to Oi and may output data signals in a time-shared manner to the data output lines D1 to Dm whose number exceeds that of the data input lines O1 to Oi.

Thus each pixel PXL may receive data signals through the data output lines D1 to Dm.

The demultiplexers 50 may receive an initializing voltage from the data driver 30 and transfer the initializing voltage to the data output lines D1 to Dm. For example, the demultiplexers 50 may receive an initializing voltage from the data input lines O1 to Oi and output the initializing voltage to the data output lines D1 to Dm whose number exceeds that of the data input lines O1 to Oi.

There may exist a capacitor 90 in (e.g., coupled to) each data output line D1 to Dm in order to save signals and voltages applied to the data output lines D1 to Dm. Here, the capacitors 90 existent in the data output lines D1 to Dm may be there as a result of the parasitic capacitance present in the wiring. Alternatively, the capacitors 90 may be ones physically installed in the data output lines D1 to Dm.

The demultiplexer controller 60 may control the operation of the demultiplexers 50 through data control signals Cd.

For example, the data control signals Cd may control the operation of transistors included in each demultiplexer 50.

The demultiplexer controller 60 may be input with demultiplexer control signals MCS supplied from the timing controller 70 and generate data control signals Cd corresponding to the demultiplexer control signals MCS.

Though FIG. 1 shows the demultiplexer controller 60 to be separate from the timing controller 70, the demultiplexer controller 60 may be realized as one body (e.g., as one integrated chip or unit) with the timing controller 70.

The timing controller 70 may control the scan driver 10, the emission driver 20, the data driver 30, and the demultiplexer controller 60.

For this, the timing controller 70 may supply scan driver control signals SCS and emission driver control signals ECS to the scan driver 10 and the emission driver 20, respectively. The timing controller 70 may supply data driver control signals DCS and demultiplexer control signals MCS to the data driver 30 and the demultiplexer controller 60, respectively.

Though FIG. 1 shows the scan driver 10, the emission driver 20, the data driver 30, the demultiplexer controller 60, and the timing controller 70 to be separate for ease of illustration, at least a portion of them may be combined as one body (e.g., as one integrated chip or unit).

The first power supply ELVDD and the second power supply ELVSS may supply a source voltage to pixels PXL located in a pixel part 80. For example, the first power supply ELVDD may be at a high potential, and the second power supply may be at a low potential.

For example, the first power supply ELVDD may be set to a positive voltage, and the second power supply ELVSS may be set to a negative voltage or a ground voltage.

Figure 2:
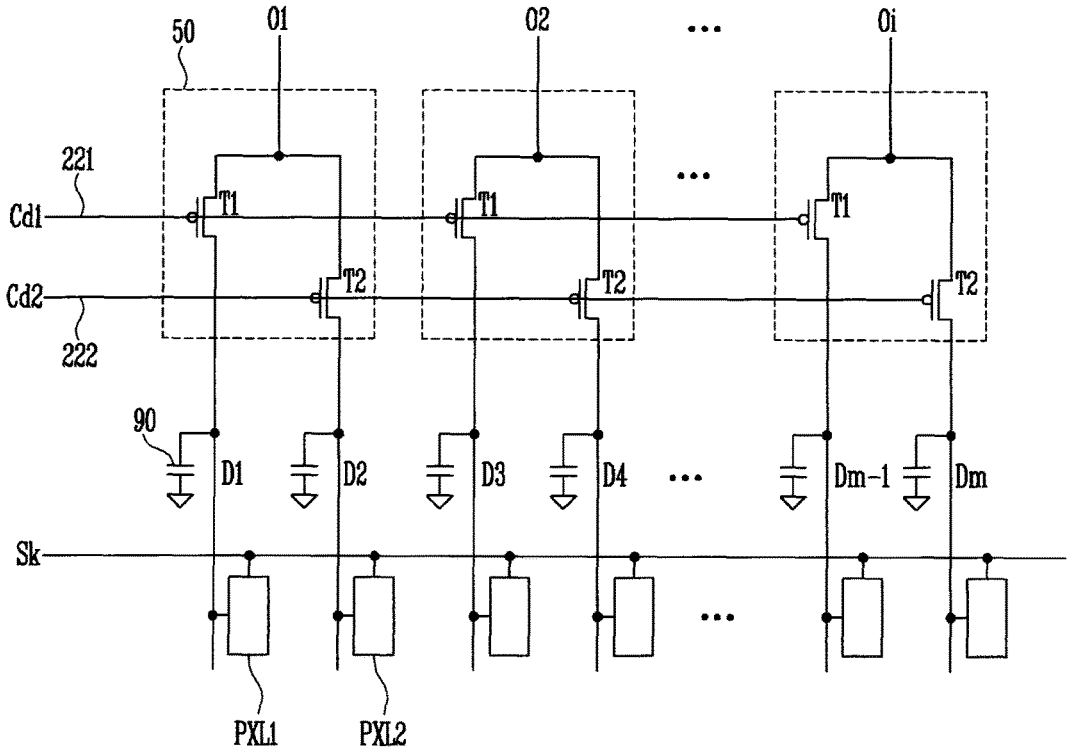
FIG. 2 illustrates a demultiplexer in accordance with an embodiment of the present invention.

FIG. 2 illustrates a demultiplexer in accordance with an embodiment of the present invention. In FIG. 2, only those pixels PXL coupled to a $k^{th}$ scan line SK are shown for ease of illustration, and explanations are centered around a demultiplexer 50 coupled to a first data input line O1, a first data output line D1, and a second data output line D2.

The pixel coupled to the first data output line D1 may be referred to as a first pixel PXL1, and the pixel coupled to the second data output line D2 may be referred to as a second pixel PXL2.

The demultiplexer 50 may be applied to pentile pixel structures.

For example, the first pixels PXL1 coupled to the first data output line D1 may be made up of pixels expressing a first color, and the second pixels PXL2 coupled to the second data output lines D2 may be made up of pixels expressing a second color and a third color. Here, the first color, the second color, and the third color may be green, red, and blue, respectively.

In another embodiment, the first pixels PXL1 coupled to the data output line D1 may be made up of pixels expressing the second color and the third color, and the second pixels PXL2 coupled to the second data output line D2 may be made up of pixels expressing the first color.

Referring to FIG. 2, a demultiplexer 50 in accordance with an embodiment may include a first transistor T1 and a second transistor T2.

The first transistor T1 may be connected between the first data input line O1 and the first data output line D1. The first transistor T1 may be turned on in response to a first data control signal Cd1. For example, the first transistor T1 may include a first electrode coupled to the first data input line O1, a second electrode coupled to the first data output line D1, and a gate electrode coupled to the a first data control line 221.

The first data control line 221 may receive the first data control signal Cd1 from the demultiplexer controller 60 and transfer it to the first transistor T1.

The second transistor T2 may be coupled between the first data input line O1 and the second data output line D2. The second transistor T2 may be turned on in response to a second data control signal Cd2.

For example, the second transistor T2 may include a first electrode coupled to the first data input line O1, a second electrode coupled to the second data output line D2, and a gate electrode coupled to a second data control line 222.

The second data control line 222 may receive the second data control signal Cd2 from the demultiplexer controller 60 and transfer it to the second transistor T2.

As shown in FIG. 2, the first transistor T1 and the second transistor T2 may be realized as p-type (e.g., p-channel) transistors. However, they are not limited thereto. The first transistor T1 and the second transistor T2 may be realized as n-type (e.g., n-channel) transistors as well.

Figure 3:
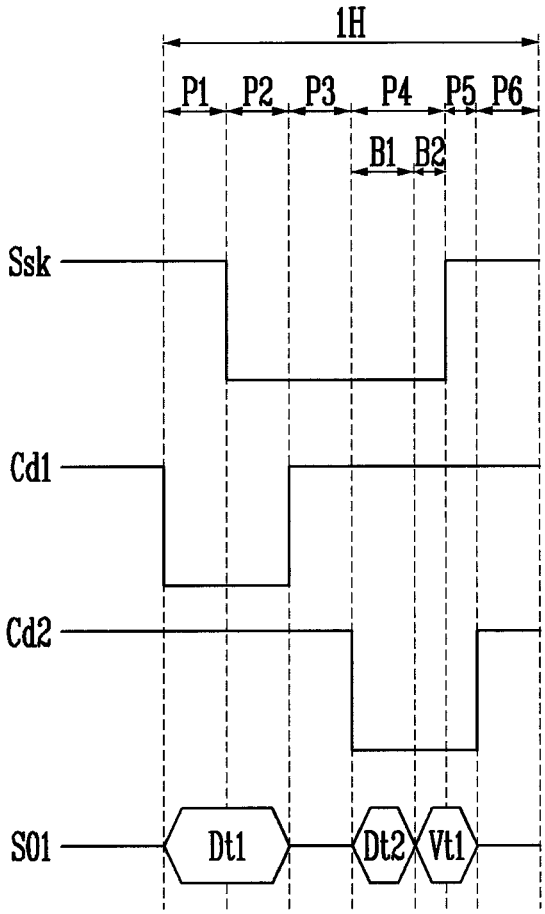
FIG. 3 is a waveform diagram illustrating an operation of a demultiplexer in accordance with an embodiment of the present invention.

FIG. 3 is a waveform diagram illustrating an operation of a demultiplexer in accordance with an embodiment of the present invention. In FIG. 3, during a first horizontal period 1H, a scan signal Ssk supplied to a k-th scan line Sk, a first data control signal Cd1, a second data control signal Cd2, and a signal S01 supplied to a first data input line O1 are shown.

Though FIG. 3 shows the scan signal Ssk, the first data control signal Cd1, and the second data control signal Cd2 set to low-level voltages, it assumes transistors, which receive respective signals Ssk, Cd1, or Cd2, are p-type (e.g., p-channel) transistors. However, when transistors receiving respective signals Ssk, Cd1, and Cd2 are n-type (e.g., n-channel) transistors, the signals Ssk, Cd1, and Cd2 may be set to high-level voltages.

The scan signal Ssk may overlap the first data control signal Cd1 and the second data control signal Cd2. For example, a portion of the scan signal Ssk may overlap a portion of the first data control signal Cd1, and the other scan signal Ssk may overlap a portion of the second data control signal Cd2. In other words, a portion of the period during which the scan signal Ssk is supplied may overlap a portion of the turn-on period of the first transistor T1, and another portion of the period during which the scan signal Ssk is supplied may overlap a portion of the turn-on period of the second transistor T2.

The first data control signal Cd1 and the second data control signal Cd2 may not overlap each other, and the first data control signal Cd1 may be supplied before the second data control signal Cd2. In other words, the turn-on period of the first transistor T1 and the turn-on period of the second transistor T2 may not overlap each other, and the turn-on period of the first transistor T1 may take place before the turn-on period of the second transistor T2. For example, the scan signal Ssk and the first data control signal may overlap each other for a portion of a second period P2, and the scan signal Ssk and the second data control signal Cd2 may overlap for a portion of a fourth period P4. For example, the first data control signal Cd1 may be supplied during a first period P1 and the second period P2, the scan signal Ssk may be supplied during the second period P2, a third period P3, and the fourth period P4, and the second data control signal Cd2 may be supplied during the fourth period P4 and a fifth period P5.

Referring to FIG. 2 and FIG. 3, detailed operations of a demultiplexer 50 in accordance with an embodiment will be further described.

First, during the first period P1, the first data control signal Cd1 may be supplied. Thus, the first transistor T1 may be turned on.

As the second data control signal Cd2 is not supplied, the second transistor T2 may stay off during the first period P1.

The data driver 30 may supply a first data signal Dt1 to the first data input line O1 while the first data control signal Cd1 is supplied.

In other words, as the first transistor T1 stays on while the first data control signal Cd1 is supplied, the data driver 30 may supply the first data signal Dt1 to the first data input line O1 during the turn-on period of the first transistor T1 (e.g., the first period P1 and the second period P2).

Thus, as during the first period P1, the first data signal Dt1 is supplied to the first data input line O1, and as the first transistor T1 stays on, the first data signal Dt1 may be transferred to the first data output line D1 through the first data input line O1 and the first transistor T1.

During the first period P1, the first data output line D1 may be charged by the first data signal Dt1. During the second period P2, the first data control signal Cd1 and the scan signal Ssk may be supplied. During the second period P2, as the supply of the first data control signal Cd1 and the first data signal Dt1 is maintained, the potential of the first data output line D1 may stay the same or substantially the same as during the first period P1.

As the scan signal Ssk is supplied to the $k^{th}$ scan line Sk, the first data signal Dt1 of the first data output line D1 may be applied to (e.g., entered into) the first pixel PXL1.

During the third period P3, the scan signal Ssk may be supplied. As the first data control signal Cd1 and the second data control signal Cd2 are not supplied, the first transistor T1 and the second transistor T2 may stay off during the third period P3.

The third period P3 may be a period to prevent the overlapping of the first data control signal Cd1 and the second data control signal Cd2, and may be set to be a short amount of time or may be omitted.

During the fourth period P4 the scan signal Ssk and the second data control signal Cd2 may be supplied. As the second data control signal CD2 is supplied, the second transistor T2 may be turned on. As the first data control signal Cd1 is not supplied, the first transistor T1 may stay off during the fourth period P4.

The data driver 30 may supply a second data signal Dt2 and a first initializing voltage Vt1 to the first data input line O1 in sequence while the second data control signal Cd2 is supplied.

In other words, as the second transistor T2 stays on while the second data control signal Cd2 is supplied, the data driver 30 may supply the second data signal Dt2 and the first initializing voltage Vt1 to the first data input line O1 in sequence during the turn-on period of the second transistor T2 (e.g., the fourth period P4 and the fifth period P5).

For example, the data driver 30 may supply the second data signal Dt2 to the first data input line O1 during a first sub-period B1 included in the fourth period P4, and may supply the first initializing voltage Vt1 to the first data input line O1 during a second sub-period B2 included in the fourth period P4 and during the fifth period P5.

In this case, during the first sub-period B1 (included in the fourth period P4), the second data signal Dt2 may be supplied to the first data input line O1, and as the second transistor T2 stays on, the second data signal Dt2 may be transferred to the second data output line D2 through the first data input line O1 and the second transistor T2.

Here, as the scan signal Ssk is being supplied, the second data signal Dt2 of the second data output line D2 may be applied to (e.g., entered into) the second pixel PXL2 concurrently.

As the first initializing voltage Vt1 is supplied to the first data input line O1 during the second sub-period B2 (included in the fourth period P4), and as the second transistor T2 stays on, the first initializing voltage Vt1 may be transferred to the second data output line D2 through the first data input line O1 and the second transistor T2.

Thus, during the second sub-period B2 (included in the fourth period P4), the second data output line D2 may be initialized by the first initializing voltage Vt1.

Alternatively, the data driver 30 may supply the second data signal Dt2 to the first data input line O1 during the fourth period P4.

In this case, as the second data signal Dt2 is supplied to the first data input line O1 during the fourth period P4, and as the second transistor T2 stays on, the second data signal Dt2 may be transferred to the second data output line D2 through the first data input line O1 and the second transistor T2.

Here, as the scan signal Ssk is being supplied, the second data signal Dt2 of the second data output line D2 may be applied to (e.g., entered into) the second pixel PXL2 concurrently.

During the fifth period P5, the second data control signal Cd2 may be supplied. As the first data control signal Cd1 is not supplied, the first transistor T1 may stay off during the fifth period P5.

As the first initializing voltage Vt1 is supplied to the first data input line O1 during the fifth period P5, and as the second transistor T2 stays on, the first initializing voltage Vt1 may be transferred to the second data output line D2 through the first data input line O1 and the second transistor T2.

Thus, the second data output line D2 may be initialized by the first initializing voltage Vt1.

As the second data output line D2 is initialized to a low voltage (e.g., the first initializing voltage Vt1) during the fifth period P5, the voltage level of the second data output line D2 during the next horizontal period may easily (e.g., quickly) be changed to the voltage of a new second data signal Dt2.

During a sixth period P6, the supply of the scan signal Ssk, the first data control signal Cd1, and the second data control signal Cd2 may all be stopped.

Accordingly, the first transistor T1 and the second transistor T2 may stay off.

For example, the first initializing voltage Vt1 may be a voltage lower than the second data signal Dt2 or the same as the lowest voltage within the voltage rage of the second data signal Dt2.

As resolution becomes higher, the length of a horizontal period 1H gets shorter and shorter. However, as the length of the horizontal period 1H becomes shorter, there may be problems with the picture quality of a display device, such as smudges, if insufficient supply time of scan signals is secured.

Figure 8A:
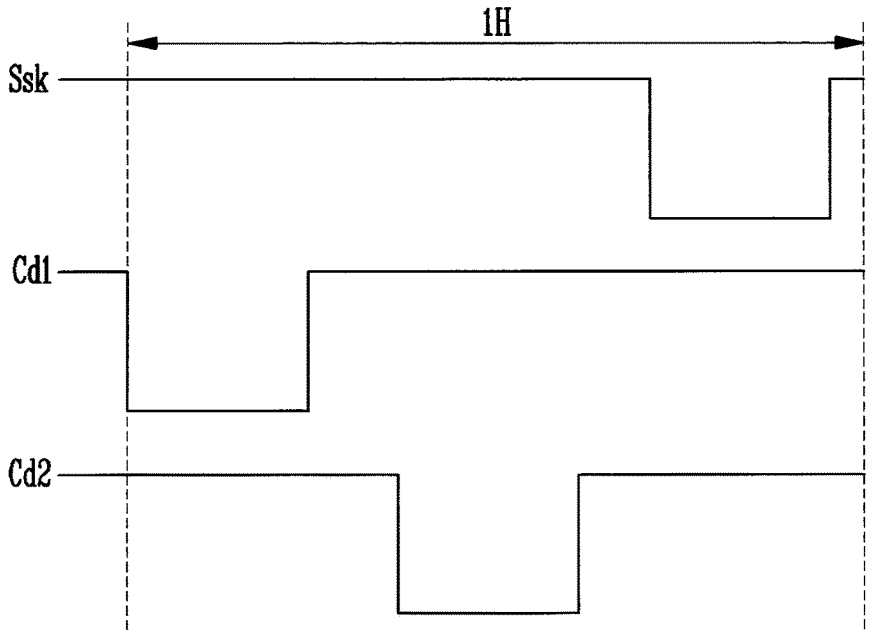
FIGS. 8A-8B are comparative examples for comparison with an embodiment of the present invention.

In the first comparative example shown in FIG. 8A, it shows a case in which the first data control signal Cd1 and the second data control signal Cd2 are supplied before the scan signal Ssk so that the first data control signal Cd1 and the second data control signal Cd2 may not overlap the scan signal Ssk.

However, in the case of the first comparative example, there is the shortcoming of not securing enough supply time of the scan signal Ssk as there is a limit to the length of the horizontal period 1H.

In an embodiment, sufficient supply time of the scan signal Ssk may be secured, as compared to the first comparative example, by partially overlapping the first data control signal Cd1 and the second data control signal Cd2 with the scan signal Ssk.

Figure 8B:
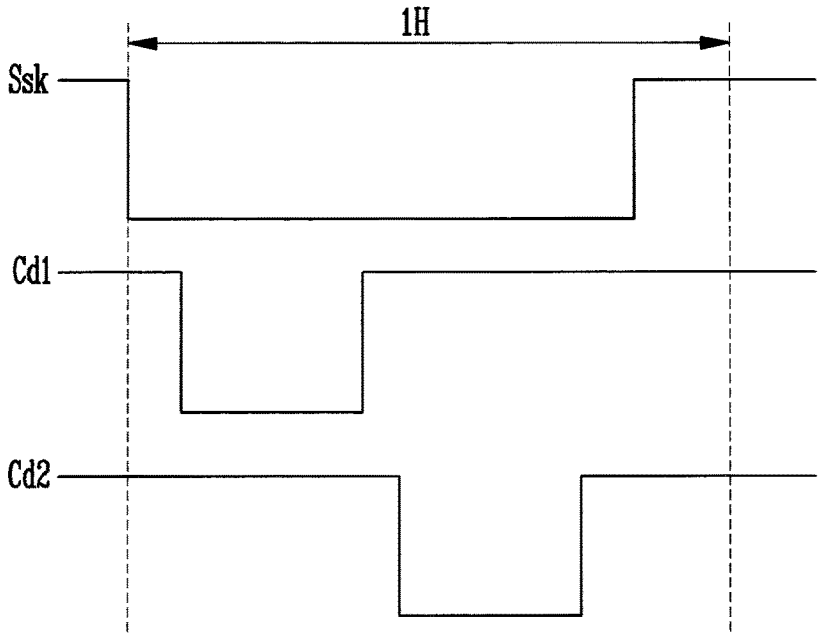

The second comparative example shown in FIG. 8B shows a case in which the first data control signal Cd1 and the second data control signal Cd2 are supplied in such a way that the first data control signal Cd1 and the second data control signal Cd2 completely overlap the scan signal Ssk.

However, in the second comparative example, when high voltage is charged in the second data output line D2 in advance, there may be the shortcoming that the potential of the second data output line D2 does not change when a data signal with a low voltage, during the horizontal period 1H, is supplied to the second data output line D2.

Thus, the intended data signals may not be applied to pixels coupled to the second data output line D2, and accordingly, problems with picture quality may arise.

In comparison, in an embodiment, by initializing the second data output line D2 in advance, data signals supplied during the next horizontal period may be normally charged to the second data output line D2.

Figure 4:
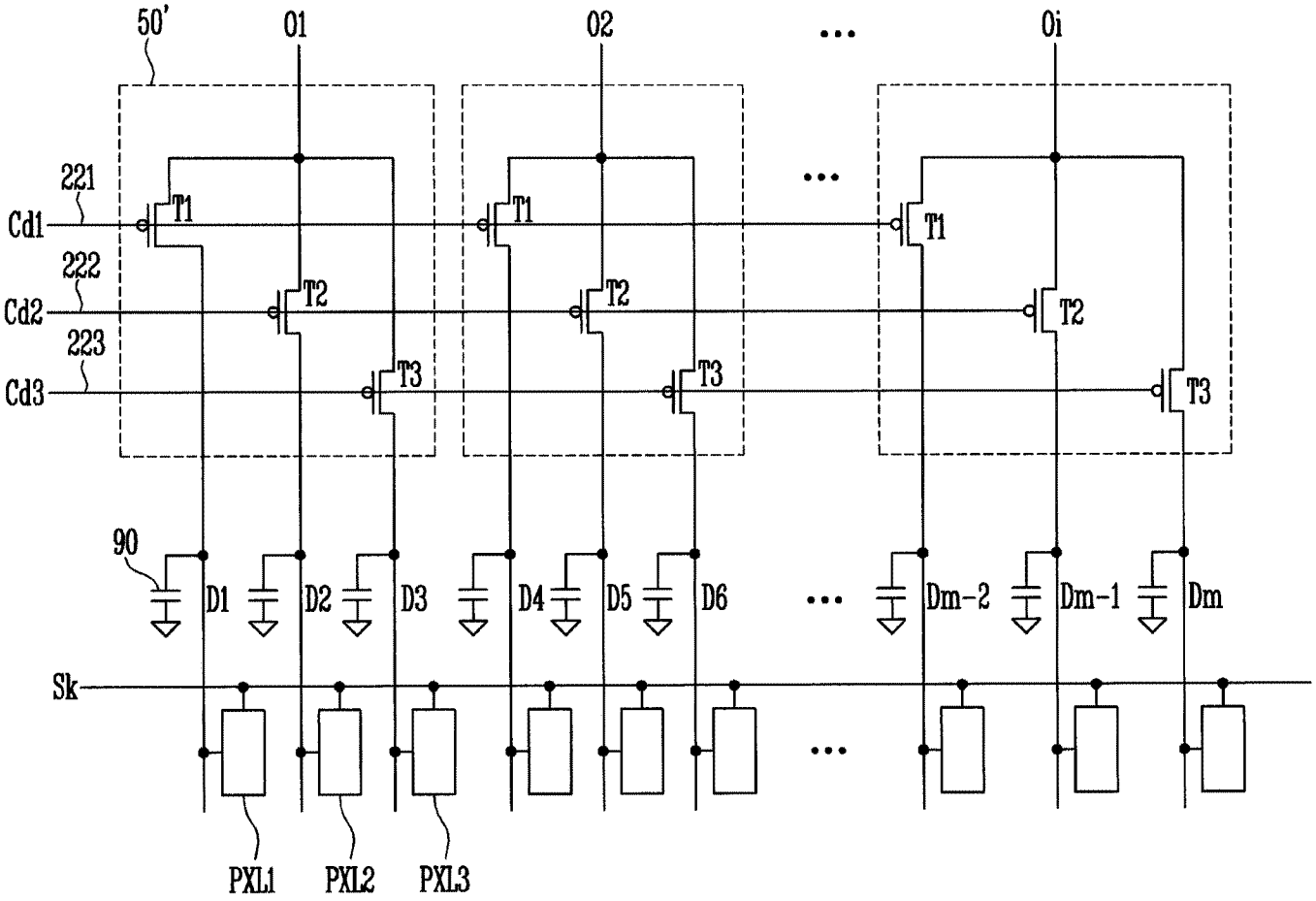
FIG. 4 illustrates a demultiplexer in accordance with another embodiment of the present invention.

FIG. 4 illustrates a demultiplexer in accordance with another embodiment of the present invention. FIG. 4 shows only those pixels PXL coupled to the $k^{th}$ scan line Sk for ease of illustration, and explanations will be centered around the demultiplexer 50 coupled to the first data input line O1, the first data output line D1, the second data output line D2, and a third data output line D3.

The pixel coupled to the first data output line D1 may be referred to as the first pixel PXL1, the pixel coupled to the second data output line D2 may be referred to as the second pixel PXL2, and the pixel coupled to the third data output line D3 may be referred to as a third pixel PXL3.

The demultiplexer 50' described herein may be applied to RGB pixel structure.

For example, the first pixels PXL1 coupled to the first data output line D1 may be made up of pixels expressing the first color, the second pixels PXL2 coupled to the second data output line D2 may be made up of pixels expressing the second color, and the third pixels PXL3 coupled to the third data output line D3 may be made up of pixels expressing the third color.

Here, the first color, the second color, and the third color may be colors different from each other and may be selected from a group consisting of green, red, and blue.

Referring to FIG. 4, a demultiplexer 50' in accordance with an embodiment may include the first transistor T1, the second transistor T2, and a third transistor T3.

The first transistor T1 may be coupled between the first data input line O1 and the first data output line D1.

The first transistor may be turned on in response to the first data control signal Cd1.

For example, the first transistor T1 may include the first electrode coupled to the first data input line O1, the second electrode coupled to the first data output line D1, and the gate electrode coupled to the first data control line 221.

The first data control line 221 may receive the first data control signal Cd1 from the demultiplexer controller 60 and transfer it to the first transistor T1.

The second transistor T2 may be connected between the first data input line O1 and the second data output line D2.

The second transistor T2 may be turned on in response to the second data control signal Cd2.

For example, the second transistor T2 may include the first electrode coupled to the first data input line O1, the second electrode coupled to the second data output line D2, and the gate electrode coupled to the second data control line 222.

The second data control line 222 may receive the second data control signal Cd2 from the demultiplexer controller 60 and transfer it to the second transistor T2.

The third transistor T3 may be coupled between the first data input line O1 and the third data output line D3.

The third transistor T3 may be turned on in response to a third data control signal Cd3.

For example, the third transistor T3 may include the first electrode coupled to the first data input line O1, the second electrode coupled to the third data output line D3, and the gate electrode coupled to a third data control line 223.

The third data control line 223 may receive the third data control signal Cd3 from the demultiplexer controller 60 and transfer it to the third transistor T3.

As shown in FIG. 4, the first transistor T1, the second transistor T2, and the third transistor T3 may be realized as p-type (e.g., p-channel) transistors. However, they are not limited thereto, and the transistors T1, T2, and T3 may be realized as n-type (e.g., n-channel) transistors.

Figure 5:
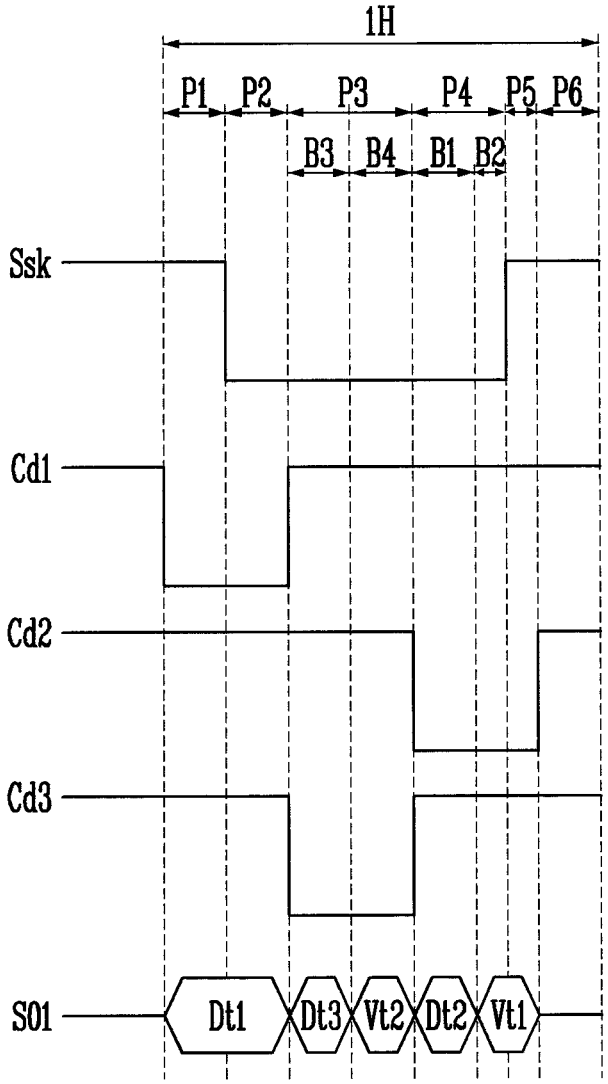
FIG. 5 is a waveform diagram illustrating an operation of a demultiplexer in accordance with another embodiment of the present invention.

FIG. 5 is a waveform diagram illustrating an operation of a demultiplexer in accordance with another embodiment of the present invention. FIG. 5 shows the scan signal Ssk supplied to the $k^{th}$ scan line Sk, the first data control signal Cd1, the second data control signal Cd2, the third data control signal Cd3, and a signal S01 supplied to the first data input line O1.

In FIG. 5, the scan signal Ssk, the first data control signal Cd1, the second data control signal Cd2, and the third data control signal Cd3 are low-level voltages, on the assumption that the transistors receiving the signals Ssk, Cd1, Cd2, and Cd3 are p-type (e.g., p-channel) transistors.

Therefore, when the transistors receiving the signals Ssk, Cd1, Cd2, and Cd3 are n-type (e.g., n-channel) transistors, the signals Ssk, Cd1, Cd2, and Cd3 may be high-level voltages.

The scan signal Ssk may overlap the first data control signal Cd1, the second data control signal Cd2, and the third data control signal Cd3.

For example, a portion of the scan signal Ssk may overlap a portion of the first data control signal Cd1, another portion of the scan signal Ssk may overlap a portion of the second data control signal Cd2, and yet another portion of the scan signals Ssk may overlap all of the third data control signal Cd3.

In other words, a portion of the supply period of the scan signal Ssk may overlap a portion of the turn-on period of the first transistor T1, another portion of the supply period of the scan signal Ssk may overlap a portion of the turn-on period of the second transistor T2, and yet another portion of the supply period of the scan signal Ssk may entirely overlap the turn-on period of the third transistor T3.

The first data control signal Cd1, the second data control signal Cd2, and the third data control signal Cd3 may not overlap one another.

In other words, the turn-on period of the first transistor T1, the turn-on period of the second transistor T2, and the turn-on period of the third transistor T3 may not overlap one another.

The first data control signal Cd1 may be supplied before the second data control signal Cd2 and the third data control signal Cd3, and the third data control signal Cd3 may be supplied before the second data control signal Cd2.

In other words, the turn-on period of the first transistor T1 may proceed before the turn-on period of the second transistor T2 and the turn-on period of the third transistor T3, and the turn-on period of the third transistor T3 may proceed before the turn-on period of the second transistor T2

For example, the scan signal Ssk and the first data control signal Cd1 may overlap each other during the second period P2, the scan signal Ssk and the second data control signal Cd2 may overlap each other during the fourth period P4, and the scan signal Ssk and the third transistor T3 may overlap each other during the third period P3.

For example, the first data control signal Cd1 may be supplied during the first period P1 and the second period P2, the scan signal Ssk may be supplied during the second period P2, the third period P3, and the fourth period P4, the second data control signal Cd2 may be supplied during the fourth period P4 and the fifth period P5, and the third data control signal Cd3 may be supplied during the third period P3.

Referring to FIG. 4 and FIG. 5, detailed operations of a demultiplexer 50' in accordance with an embodiment will be further examined.

First, the first data control signal Cd1 may be supplied during the first period P1. Thus, the first transistor T1 may be turned on.

As the second data control signal Cd2 and the third data control signal Cd3 are not supplied, the second transistor T2 and the third transistor T3 may stay off during the first period P1.

The data driver 30 may supply the first data signal Dt1 to the first data input line O1 while the first data control signal Cd1 is supplied.

That is, as the first transistor T1 stays on while the first data control signal Cd1 is supplied, the data driver 30 may supply the first data signal Dt1 to the first data input line O1 during the turn-on period of the first transistor T1 (e.g., the first period P1 and the second period P2).

Therefore, as the first data signal Dt1 is supplied to the first data input line O1 during the first period P1, and as the first transistor T1 stays on, the first data signal Dt1 may be transferred to the first data output line D1 through the first data input line O1 and the first transistor T1.

During the first period P1, the first data output line D1 may be charged by the first data signal Dt1.

During the second period, P2 the first data control signal Cd1 and the scan signal Ssk may be supplied.

As the supply of the first data control signal Cd1 and the first data signal Dt1 is maintained during the second period P2, the potential of the first data output line D1 may stay the same or substantially the same as during the first period P1.

As the scan signal Ssk is supplied to the k-th scan line Sk, the first data signal Dt1 of the first data output line D1 may be applied to (e.g., entered into) the first pixel PXL1.

During the third period P3, the scan signal Ssk and the third data control signal Cd3 may be supplied. As the first data control signal Cd1 and the second data control signal Cd2 are not supplied, the first transistor T1 and the second transistor T2 may stay off during the third period P3.

The data driver 30 may supply a third data control signal Dt3 and a second initializing voltage Vt2 to the first data input line O1 in sequence while the third data control signal Cd3 is supplied.

In other words, as the third transistor T3 stays on while the third data control signal Cd3 is supplied, the data driver 30 may supply the third data signal Dt3 and the second initializing voltage Vt2 to the first data input line O1 in sequence during the turn-on period of the third transistor T3 (e.g., the third period P3).

For example, the data driver 30 may supply the third data signal Dt3 to the first data input line O1 during a first sub-period B3 included in the third period P3, and may supply the second initializing voltage Vt2 to the first data input line O1 during a second sub-period B4 included in the third period P3.

In this case, as the third data signal Dt3 is supplied to the first data input line O1 during the first sub-period B3 included in the third period P3, and as the third transistor T3 stays on, the third data signal Dt3 may be transferred to the third data output line D3 through the first data input line O1 and the third transistor T3.

Here, as the scan signal Ssk is being supplied, the third data signal Dt3 of the third data output line D3 may be applied to (e.g., entered into) the third pixel PXL3 concurrently.

As the second initializing voltage Vt2 is supplied to the first data input line O1 during the second sub-period B4 included in the third period P3, and as the third transistor T3 stays on, the second initializing voltage Vt2 may be transferred to the third data output line D3 through the first data input line O1 and the third transistor T3.

Thus, during the second sub-period included in the third period P3, the third data output line D3 may be initialized by the second initializing voltage Vt2.

During the third period P3, as the third data output line D3 is initialized to a low voltage (e.g., the second initializing voltage Vt2), the voltage level of the third data output line D3 may easily (e.g., quickly) be changed to the voltage of a new third data signal Dt3.

During the fourth period P4, the scan signal Ssk and the second data control signal Cd2 may be supplied.

As the second data control signal Cd2 is supplied, the second transistor T2 may be turned on.

As the first data control signal Cd1 and the third data control signal Cd3 are not supplied, the first transistor T1 and the third transistor T3 may stay off during the fourth period P4.

The data driver 30 may supply the second data signal Dt2 and the first initializing voltage Vt1 to the first data input line O1 in sequence during the period when the second data control signal Cd2 is supplied.

In other words, as the second transistor T2 stays on while the second data control signal Cd2 is supplied, the data driver 30 may supply the second data signal Dt2 and the first initializing voltage Vt1 to the first data input line O1 in sequence during the turn-on period of the second transistor T2 (e.g., the fourth period P4 and the fifth period P5).

For example, the data driver 30 may supply the second data signal Dt2 to the first data input line O1 during the first sub-period B1 (included in the fourth period P4), and may supply the first initializing voltage Vt1 to the first data input line O1 during the second sub-period B2 (included in the fourth period P4) and the fifth period P5.

In this case, as the second data signal Dt2 is supplied to the first data input line O1 during the first sub-period B1 (included in the fourth period P4), and as the second transistor T2 stays on, the second data signal Dt2 may be transferred to the second data output line D2 through the first data input line O1 and the second transistor T2.

Here, as the scan signal Ssk is being supplied, the second data signal Dt2 of the second data output line D2 may be applied to (e.g., entered into) the second pixel PXL2 concurrently.

As the first initializing voltage Vt1 may be supplied to the first data input line O1 during the second sub-period B2 (included in the fourth period), and as the second transistor T2 stays on, the first initializing voltage Vt1 may be transferred to the second data output line D2 through the first data input line O1 and the second transistor T2.

Thus, during the second sub-period B2 (included in the fourth period P4), the second data output line D2 may be initialized by the first initializing voltage Vt1.

Generally, the data driver 30 may supply the second data signal Dt2 to the first data input line O1 during the fourth period P4. In this case, as the second data signal Dt2 is supplied to the first data input line O1 during the fourth period P4, and as the second transistor T2 stays on, the second data signal Dt2 may be transferred to the second data output line D2 through the first data input line O1 and the second transistor T2.

Here, as the scan signal Ssk is being supplied, the second data signal Dt2 of the second data output line D2 may be applied to (e.g., entered into) the second pixel PXL2.

During the fifth period P5, the second data control signal Cd2 may be supplied. As the first data control signal Cd1 and the third data control signal Cd3 are not supplied, the first transistor T1 and the third transistor T3 may stay off during the fifth period.

As the first initializing voltage Vt1 is supplied to the first data input line O1 during the fifth period P5, and as the second transistor T2 stays on, the first initializing voltage Vt1 may be transferred to the second data output line D2 through the first data input line O1 and the second transistor T2.

Thus, the second data output line D2 may be initialized by the first initializing voltage Vt1.

During the fifth period P5, as the second data output line D2 is initialized to a low voltage (e.g., the first initializing voltage Vt1), the voltage level of the second data output line D2 may easily (e.g., quickly) be changed to the voltage of a new second data signal Dt2.

During the sixth period P6, the supply of the scan signal Ssk, the first data control signal Cd1, the second data control signal Cd2, and the third data control signal Cd3 may all be stopped. Accordingly, the first transistor T1, the second transistor T2, and the third transistor T3 may stay off.

For example, the first initializing voltage Vt1 may be a voltage lower than the second data signal Dt2 or the lowest voltage within the voltage range of the second data signal Dt2.

The second initializing voltage Vt2 may be a voltage lower than the third data signal Dt3 or the lowest voltage within the voltage range of the third data signal Dt3.

Here, the first initializing voltage Vt1 may be the same as the second initializing voltage Vt2.

Figure 6:
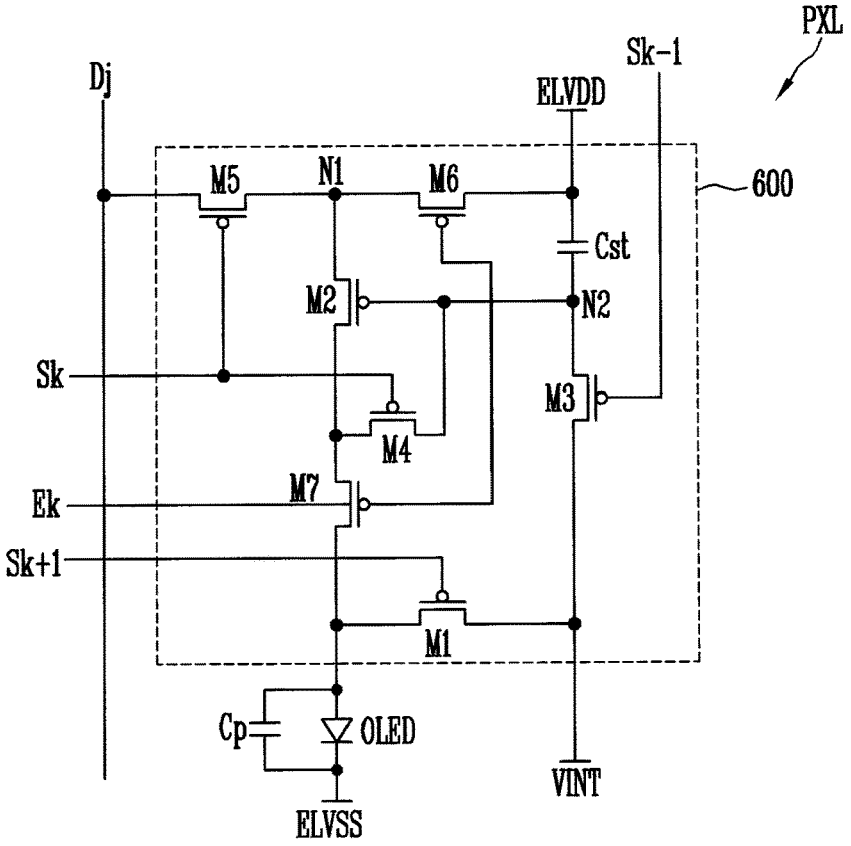
FIG. 6 illustrates a pixel shown in FIG. 1 in accordance with an embodiment of the present invention.

FIG. 6 illustrates a pixel shown in FIG. 1 in accordance with an embodiment of the present invention. FIG. 6 shows the pixel PXL connected to the $k^{th}$ scan line Sk and a $j^{th}$ data line Dj for ease of illustration. Here, k is a natural number equal to or less than n, and j is a natural number equal to or less than m.

Referring to FIG. 6, a pixel PXL in accordance with an embodiment may include an organic light emitting diode OLED and a pixel circuit 600.

The anode of the OLED may be coupled to the pixel circuit 600, and the cathode may be coupled to the second power supply ELVSS.

The OLED may generate light having a designated luminance in response to the current supplied from the pixel circuit 600.

The pixel circuit 600 may be located among the anodes of the $j^{th}$ data line Dj, the $k^{th}$ scan line Sk, and the OLED, and may control the current supplied to the OLED.

For example, the pixel circuit 600 may control the amount of current supplied to the OLED in response to the data signal supplied to the j-th data line Dj when a scan signal is supplied to the $k^{th}$ scan line Sk.

The pixel circuit 600 may include multiple transistors M1 to M7 and a storage capacitor Cst.

The first transistor M1 may be coupled between the anode and the fixed voltage source VINT of the OLED. Here, the fixed voltage source VINT may supply a voltage lower than a data signal.

The fixed voltage source VINT may have the same voltage as the first initializing voltage Vt1 and/or the second initializing voltage Vt2.

The first transistor M1 may be turned on when a scan signal is supplied to the $(k+1)^{th}$ scan line Sk+1 and supply the voltage of the fixed voltage source VINT to the anode of OLED.

When the voltage of the fixed voltage source VINT is supplied to the anode of the OLED, the parasitic capacitor Cp existent in the OLED may be initialized.

When the parasitic capacitor Cp is initialized, the OLED may be prevented from emitting light due to the leakage current supplied from the pixel circuit 600 when executing black luminance.

In other words, the leakage current supplied from the pixel circuit 600 may charge the parasitic capacitor Cp in advance, and when it is being charged, the OLED may be set to a non-emission state.

The first electrode of the second transistor M2 (e.g., the driving transistor) may be coupled to a first node N1, and the second electrode may be coupled to the first electrode of the seventh transistor M7.

And the gate electrode of the second transistor M2 may be coupled to a second node N2. The second transistor M2, in response to the voltage charged in the storage capacitor Cst, may control the amount of current flowing into the second power supply ELVSS via the OLED from the first power supply ELVDD.

The first electrode of the third transistor M3 may be coupled to a second node N2, and the second electrode may be coupled to the fixed voltage source VINT. The gate electrode of the third transistor M3 may be coupled to the $(k-1)^{th}$ scan line Sk−1. The third transistor M3 may be turned on when a scan signal is supplied to the $(k-1)^{th}$ scan line Sk−1 and may supply the voltage of the fixed voltage source VINT to the second node N2.

The first electrode of the fourth transistor M4 may be coupled to the second electrode of the second transistor M2, and thus the second electrode may be coupled to the second node N2. The gate electrode of the fourth transistor M4 may be coupled to the $k^{th}$ scan line Sk.

The fourth transistor M4 may be turned on when a scan signal is supplied to the $k^{th}$ scan line Sk, and thus may couple the second transistor M2 in the form of a diode.

The first electrode of the fifth transistor M5 may be coupled to the $j^{th}$ data line Dj, and the second electrode may be coupled to the first node N1.

And the gate electrode of the fifth transistor M5 may be coupled to the $k^{th}$ scan line Sk.

The fifth transistor M5 may be turned on when a scan signal is supplied to the $k^{th}$ scan line Sk and transfer the data signal from the $j^{th}$ data line Dj to the first node N1.

The first electrode of the sixth transistor M6 may be coupled to the first power supply ELVDD, and the second electrode may be coupled to the first node N1.

And the gate electrode of the sixth transistor M6 may be coupled to the emission control line Ek.

The sixth transistor M6 may be turned off when an emission control signal is supplied to the $k^{th}$ emission control line Ek and turned on when the emission control signal is not supplied.

The first electrode of the seventh transistor M7 may be coupled to the second electrode of the second transistor M2, and the second electrode may be coupled to the anode of the OLED.

And the gate electrode of the seventh transistor M7 may be coupled to the $k^{th}$ emission control line Ek. The seventh transistor M7 may be turned off when an emission control signal is supplied to the $k^{th}$ emission control line Ek and turned on when the emission control signal is not supplied.

The storage capacitor Cst may be coupled between the first power supply ELVDD and the second node N2.

The above-described pixel structure of FIG. 6 is not limited thereto. In fact, the pixel circuit 600 may have a circuit structure in which electric current can be supplied to OLEDs and may be chosen as having one of the various structures as disclosed.

Figure 7:
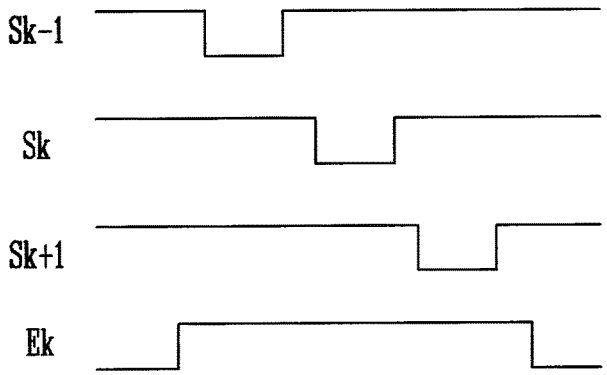
FIG. 7 is a waveform diagram illustrating an operation of the pixel shown in FIG. 6.

FIG. 7 is a waveform diagram illustrating an operation of the pixel shown in FIG. 6. Referring to FIG. 7, when emission control signals are supplied to the $k^{th}$ emission control line Ek, the sixth transistor M6 and the seventh transistor M7 may be turned off.

When the sixth transistor M6 is turned off, the electric connection between the first power supply ELVDD and the first node N1 may be blocked (or broken).

When the seventh transistor M7 is turned off, the electric connection between the second transistor M2 and the OLED may be blocked (or broken).

Thus, the OLED may be set to a non-emission state while an emission control signal is supplied to the $k^{th}$ emission control line Ek.

Thereafter, a scan signal may be supplied to the $k-1^{th}$ scan line Sk−1, and the third transistor M3 may be turned on.

When the third transistor M3 is turned on, the voltage of the fixed voltage source VINT may be supplied to the second node N2, and accordingly, the voltage of the second node N2 may be initialized as the voltage of the fixed voltage source VINT.

After the voltage of the second node N2 is initialized as the voltage of the fixed voltage source VINT, a scan signal may be supplied to the $k^{th}$ scan line Sk.

When a scan signal is supplied to the $k^{th}$ scan line Sk, the fourth transistor M4 and the fifth transistor M5 may be turned on.

When the fourth transistor M4 is turned on, the second transistor M2 may be coupled in the form of a diode.

When the fifth transistor M5 is turned on, the data signal from the $j^{th}$ data line Dj may be supplied to the first node N1.

Here, as the second node N2 is initialized by the voltage of the fixed voltage source VINT, the second transistor M2 may be turned on. When the second transistor M2 is turned on, a voltage, whose value is the value of the voltage of the data signal applied to the first node N1 with the threshold voltage of the second transistor M2 subtracted from it, is supplied to the second node N2. Here, the storage capacitor Cst may store the voltage applied to the second node N2.

After the voltage corresponding to the data signal is stored in the storage capacitor Cst, a scan signal may be supplied to the $(k+1)^{th}$ scan line Sk+1. When a scan signal is supplied to the $(k+1)^{th}$ scan line Sk+1, the first transistor M1 may be turned on.

When the first transistor M1 is turned on, the voltage of the fixed voltage source VINT may be supplied to the anode of the OLED. Then the parasitic capacitor Cp existent in the OLED may be initialized.

Thereafter, the sixth transistor M6 and the seventh transistor M7 may be turned on as the supply of the emission control signal to the $k^{th}$ emission control line Ek is stopped.

When the sixth transistor M6 and the seventh transistor M7 are turned on, a current path may be formed from the first power supply ELVDD to the second power supply ELVSS via the OLED.

Here, the second transistor M2 may supply a driving current corresponding to the voltage charged in the storage capacitor Cst to the OLED.

Accordingly, the OLED may emit light with the luminance corresponding to the driving current.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when an element or component is referred to as being "between" two elements or components, it can be the only element or component between the two elements or components, or one or more intervening elements or components may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

The display device and/or any other relevant devices, such as the demultiplexer and the pixels, or components thereof according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as defined by the following claims and equivalents thereof.

What is claimed is:

1. A display device comprising:

a first pixel coupled to a scan line and a first data output line;

a second pixel coupled to the scan line and a second data output line;

a scan driver configured to supply a scan signal to the scan line;

a data driver configured to supply a first data signal, a second data signal, and a first initializing voltage to a data input line; and a demultiplexer configured to receive the first data signal, the first initializing voltage, and the second data signal, to transmit the first data signal to the first data output line, and to transmit the second data signal and the first initializing voltage to the second data output line, wherein the first initializing voltage is a voltage lower than that of the second data signal or is a lowest voltage within a voltage range of the second data signal.

2. The display device as claimed in claim 1, wherein the demultiplexer comprises:

a first transistor coupled between the data input line and the first data output line and configured to turn on in response to a first data control signal; and a second transistor coupled between the data input line and the second data output line and configured to turn on in response to a second data control signal.

3. The display device as claimed in claim 2, wherein a first portion of the scan signal overlaps a portion of the first data control signal, and wherein a second portion of the scan signal overlaps a portion of the second data control signal.

4. The display device as claimed in claim 3, wherein the first data control signal and the second data control signal do not overlap each other.

5. The display device as claimed in claim 4, wherein the first data control signal is supplied before the second data control signal.

6. The display device as claimed in claim 2, wherein the data driver is configured to supply the first data signal to the data input line while the first data control signal is supplied, and to supply the second data signal and the first initializing voltage to the data input line in sequence while the second data control signal is supplied.

7. The display device as claimed in claim 2, wherein the first data control signal is supplied during a first period and a second period, wherein the scan signal is supplied during the second period, a third period, and a fourth period, and wherein the second data control signal is supplied during a fourth period and a fifth period.

8. The display device as claimed in claim 2, wherein the display device further comprises a third pixel coupled to the scan line and a third data output line, and wherein the demultiplexer further comprises a third transistor coupled between the data input line and the third data output line, the third transistor being configured to turn on in response to a third data control signal.

9. The display device as claimed in claim 8, wherein a first portion of the scan signal overlaps a portion of the first data control signal, wherein a second portion of the scan signal overlaps a portion of the second data control signal, and wherein a third portion of the scan signal entirely overlaps the third data control signal.

10. The display device as claimed in claim 9, wherein the first data control signal, the second data control signal, and the third data control signal do not overlap one another.

11. The display device as claimed in claim 10, wherein the first data control signal is supplied before the second data control signal and the third data control signal, and wherein the third data control signal is supplied before the second data control signal.

12. The display device as claimed in claim 8, wherein the data driver is configured to supply the first data signal to the data input line while the first data control signal is supplied, to supply the second data signal and the first initializing voltage to the data input line in sequence while the second data control signal is supplied, and to supply a third data signal and a second initializing voltage to the data input line in sequence while the third data control signal is supplied.

13. The display device as claimed in claim 12, wherein the second initializing voltage is a voltage lower than that of the third data signal or is a lowest voltage within a voltage range of the third data signal.

14. The display device as claimed in claim 8, wherein the first data control signal is supplied during a first period and a second period, wherein the scan signal is supplied during the second period, a third period, and a fourth period, wherein the second data control signal is supplied during the fourth period and a fifth period, and wherein the third data control signal is supplied during the third period.

15. The display device as claimed in claim 12, wherein the first initializing voltage is the same as the second initializing voltage.

16. A method for driving a display device, the method comprising:

supplying a first data signal to a first data output line coupled to a first pixel during a turn on period of a first transistor in a demultiplexer;

supplying a scan signal to a scan line coupled to the first pixel and a second pixel; and supplying, in sequence, a second data signal and a first initializing voltage to a second data output line coupled to the second pixel during a turn on period of a second transistor in the demultiplexer, wherein the first initializing voltage is a voltage lower than that of the second data signal or is a lowest voltage within a voltage range of the second data signal.

17. The method as claimed in claim 16, wherein a first portion of a supply period of the scan signal overlaps a portion of the turn on period of the first transistor, wherein a second portion of the supply period of the scan signal overlaps a portion of the turn on period of the second transistor, and wherein the turn on period of the first transistor precedes the turn on period of the second transistor.

18. The method as claimed in claim 16, wherein the scan line is further coupled to a third pixel, and wherein the method further comprises supplying a third data signal and a second initializing voltage, in sequence, to a third data output line coupled to the third pixel during a turn on period of a third transistor in the demultiplexer.

19. The method as claimed in claim 18, wherein a first portion of a supply period of the scan signal overlaps a portion of the turn on period of the first transistor, wherein a second portion of the supply period of the scan signal overlaps a portion of the turn on period of the second transistor, wherein a third portion of the supply period of the scan signal entirely overlaps the turn on period of the third transistor, wherein the turn on period of the first transistor precedes the turn on period of the second transistor and the turn on period of the third transistor, and wherein the turn on period of the third transistor precedes the turn on period of the second transistor.

* * * * *